US006478602B1

(12) United States Patent
Chapman et al.

(10) Patent No.: US 6,478,602 B1
(45) Date of Patent: Nov. 12, 2002

(54) RETAINER CLIP FOR AN ELECTRICAL DISTRIBUTION ASSEMBLY

(75) Inventors: Gordon Chapman, Butler, IN (US); Phil Zimmerman, Hamilton, IN (US); Todd T. Taylor, Kendallville, IN (US)

(73) Assignee: Pent Products, Inc., Kendallville, IN (US)

( * ) Notice: Subject to any disclaimer, the term of this patent is extended or adjusted under 35 U.S.C. 154(b) by 0 days.

(21) Appl. No.: 09/703,602

(22) Filed: Nov. 1, 2000

(51) Int. Cl.[7] ..... H01R 13/62

(52) U.S. Cl. ..... 439/373; 473/369; 473/215

(58) Field of Search ..... 439/373, 345, 439/350, 369, 215, 367, 371, 351, 352, 353, 354, 355, 357, 358, 368, 370, 347

(56) References Cited

U.S. PATENT DOCUMENTS

| | | | | |
|---|---|---|---|---|
| 4,489,997 A | | 12/1984 | Byrne | 339/13 |
| 4,990,110 A | | 2/1991 | Byrne | 439/861 |
| 4,993,576 A | | 2/1991 | Byrne | 220/3.9 |
| 5,041,002 A | | 8/1991 | Byrne | 439/215 |
| 5,087,207 A | | 2/1992 | Byrne | 439/215 |
| 5,096,431 A | | 3/1992 | Byrne | 439/171 |
| 5,096,434 A | | 3/1992 | Byrne | 439/215 |
| 5,171,159 A | | 12/1992 | Byrne | 439/215 |
| 5,236,370 A | * | 8/1993 | King et al. | 439/215 |
| 5,259,787 A | | 11/1993 | Byrne | 4/539 |
| 5,382,179 A | * | 1/1995 | Noschese | 439/533 |
| 5,928,011 A | * | 7/1999 | Flask et al. | 439/157 |
| 6,027,352 A | | 2/2000 | Byrne | 439/215 |
| 6,036,516 A | | 3/2000 | Byrne | 439/215 |
| 6,036,517 A | | 3/2000 | Byrne | 439/215 |

* cited by examiner

*Primary Examiner*—P. Austin Bradley
*Assistant Examiner*—Ross Gushi
(74) *Attorney, Agent, or Firm*—Taylor & Aust, P.C.

(57) ABSTRACT

An electrical distribution assembly includes a distribution block having a first electrical connector. A distribution member includes a second electrical connector, with the second electrical connector mating with the first electrical connector. A retainer clip is separate from each of the distribution block and the distribution member. The retainer clip mechanically couples with and prevents electrical decoupling of the first electrical connector and the second electrical connector.

13 Claims, 5 Drawing Sheets

RETAINER CLIP FOR AN ELECTRICAL DISTRIBUTION ASSEMBLY

BACKGROUND OF THE INVENTION

1. Field of the Invention

The present invention relates to an electrical distribution assembly in a modular wall panel, and, more particularly, to devices for coupling and retaining electrical connectors together in such an electrical distribution assembly.

2. Description of the Related Art

A modular wall panel assembly, also known as a partition or divider, is used in an office environment to define and separate work stations for individual workers. Such a wall panel assembly typically includes a wall panel with a raceway or wireway located at the bottom of the wall panel. The raceway is used to carry an electrical distribution assembly which connects with an electrical distribution assembly in an adjacent wall panel. Electrical power may thus be distributed to the individual work stations through the electrical distribution assemblies located in the modular wall panel assemblies.

An electrical distribution assembly as described above typically includes one or more electrical distribution blocks in each wall panel. The electrical distribution blocks include electrical connectors at the opposite ends thereof. Each distribution block may include an integral end connector which mates with an end connector of an adjacent distribution block. Alternatively, jumper cables using mating end connectors may be used to interconnect the distribution blocks together. The mating electrical connectors typically include one or more integral locking features which mate with corresponding integral locking features on the other connector. Although usually effective for preventing electrical decoupling between the electrical connectors, such integral locking features sometimes interfere with the coupling between the electrical connectors. Moreover, depending upon the particular locking features used, decoupling of the electrical connectors can also be difficult.

What is needed in the art is an electrical distribution system for use in a modular wall panel system which allows the electrical connectors to be easily coupled and decoupled while ensuring that unintentional electrical decoupling does not occur.

SUMMARY OF THE INVENTION

The present invention provides an electrical distribution assembly including a retainer clip which is separate from the pair of mated electrical connectors, and which mechanically couples the electrical connectors together while preventing electrical decoupling therebetween.

The invention comprises, in one form thereof, an electrical distribution assembly including a distribution block having a first electrical connector. A distribution member includes a second electrical connector, with the second electrical connector mating with the first electrical connector. A retainer clip is separate from each of the distribution block and the distribution member. The retainer clip mechanically couples with and prevents electrical decoupling of the first electrical connector and the second electrical connector.

An advantage of the present invention is that the retainer clip is a strong, metal piece which positively holds the electrical connectors together.

Another advantage is that the retainer clip is separate from the distribution block and distribution member, thereby not interfering with coupling between the mating connectors.

Yet another advantage is that the retainer clip may be constructed as a monolithic or multiple-piece part.

A further advantage is that the retainer clip may be installed by coupling first with either connector and then the other connector.

Yet another advantage is that the retainer clip may engage any selected geometric feature on either electrical connector which provides a stop for preventing axial dislocation between the connectors.

A still further advantage is that the retainer clip may be used to modify an electrical connector with an already existing distribution block so as to enable retrofitting.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
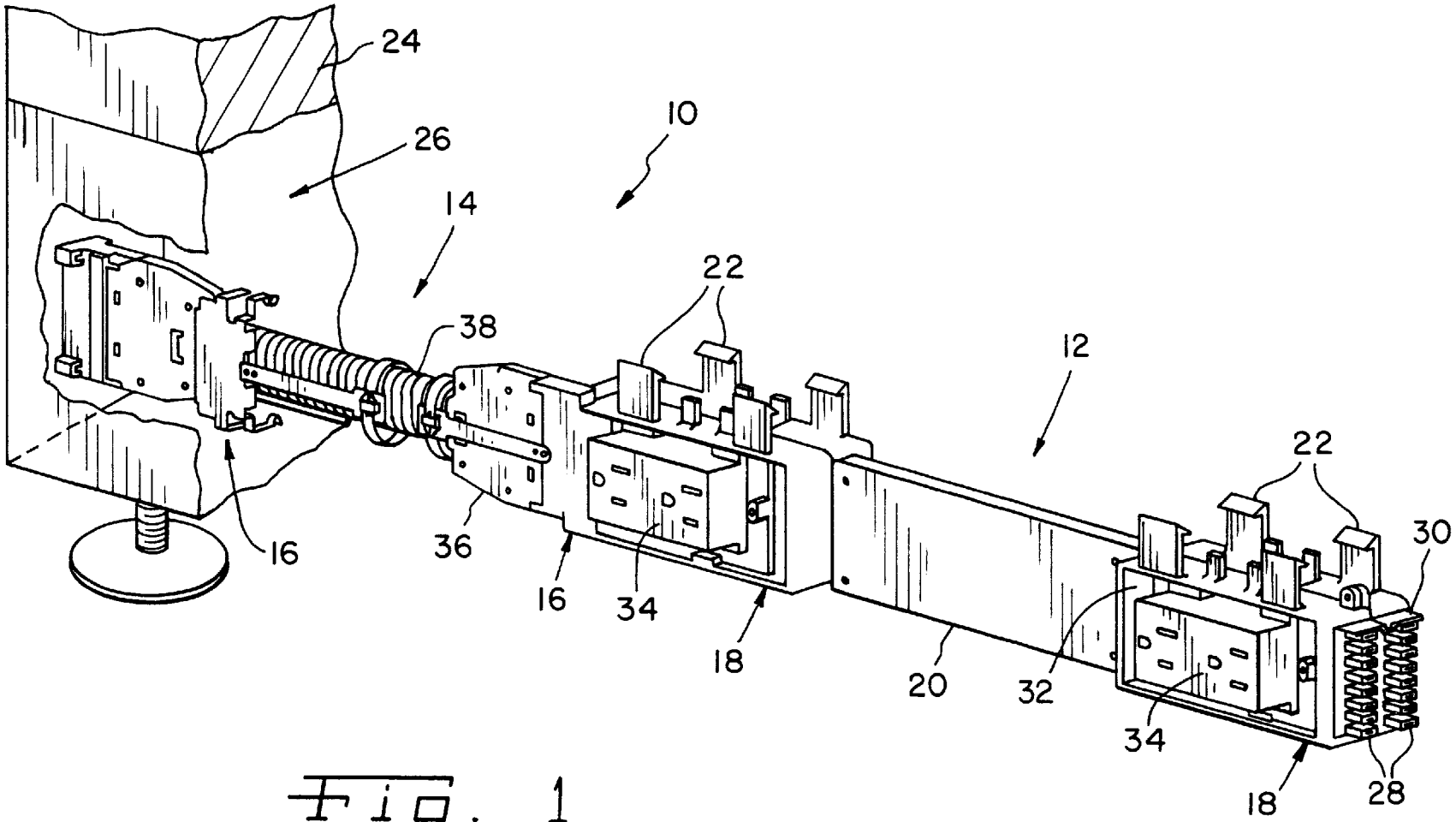
FIG. 1 is a perspective view of an electrical distribution assembly 10 of the present invention.
Figure 2:
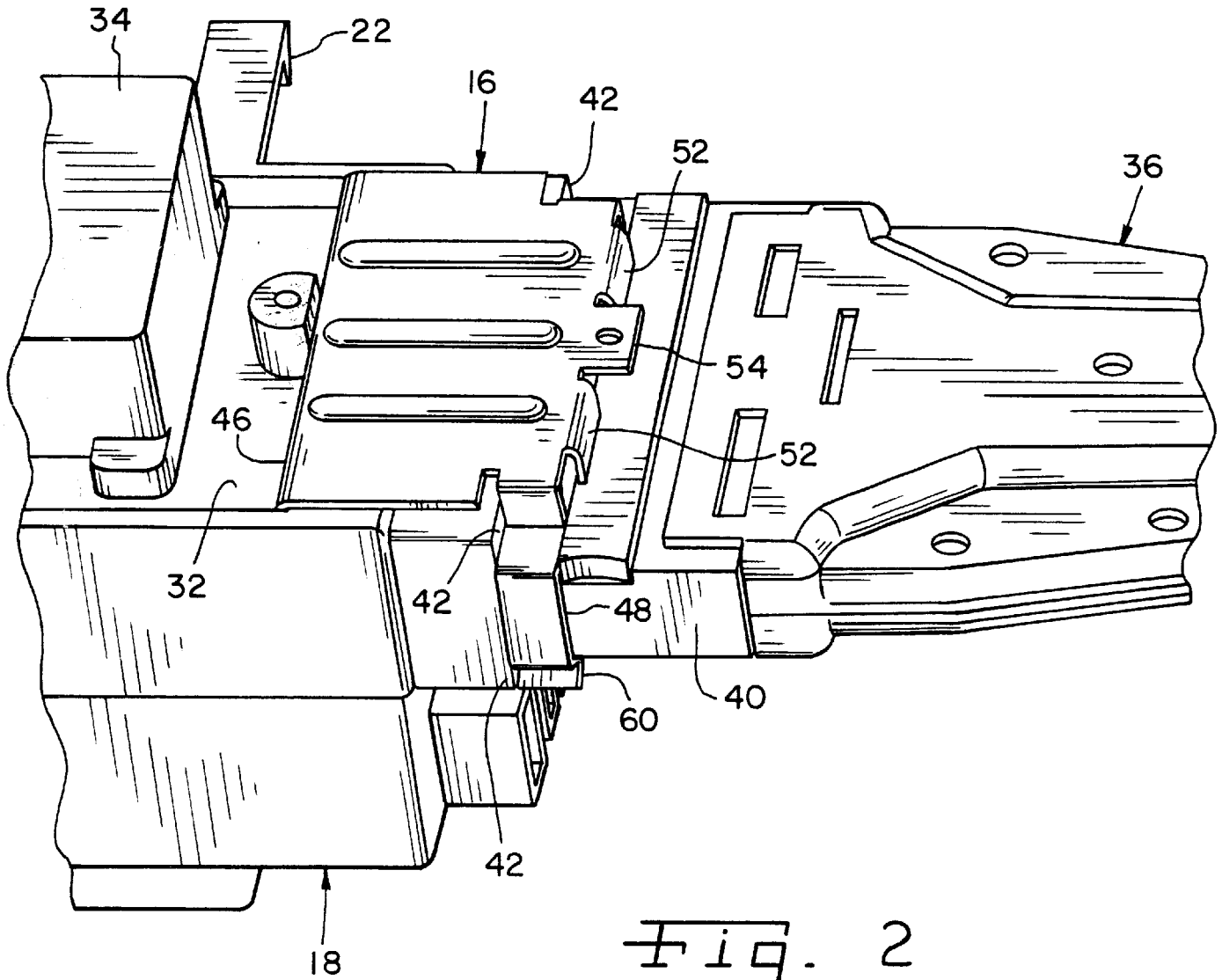
FIG. 2 is an enlarged, fragmentary view of the electrical distribution assembly of FIG. 1, illustrating an embodiment of a retainer clip of the present invention.
Figure 3:
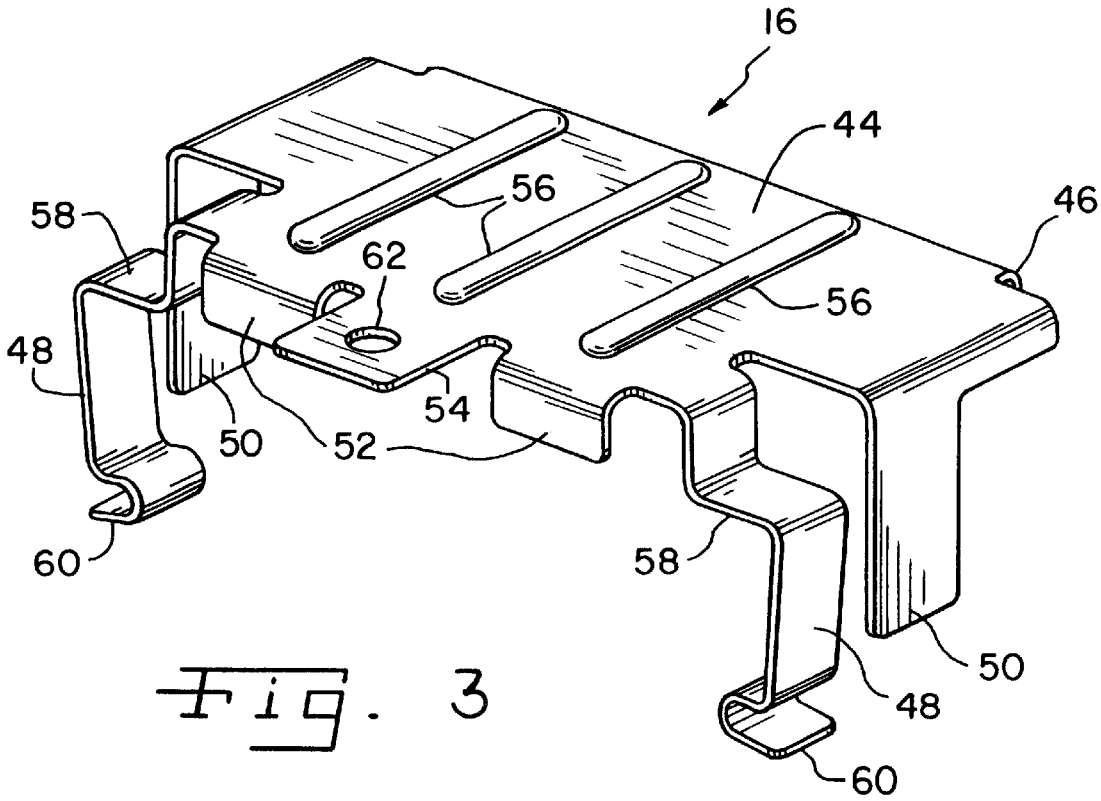
FIG. 3 is a perspective view of the retainer clip shown in FIGS. 1 and 2.
Figure 4:
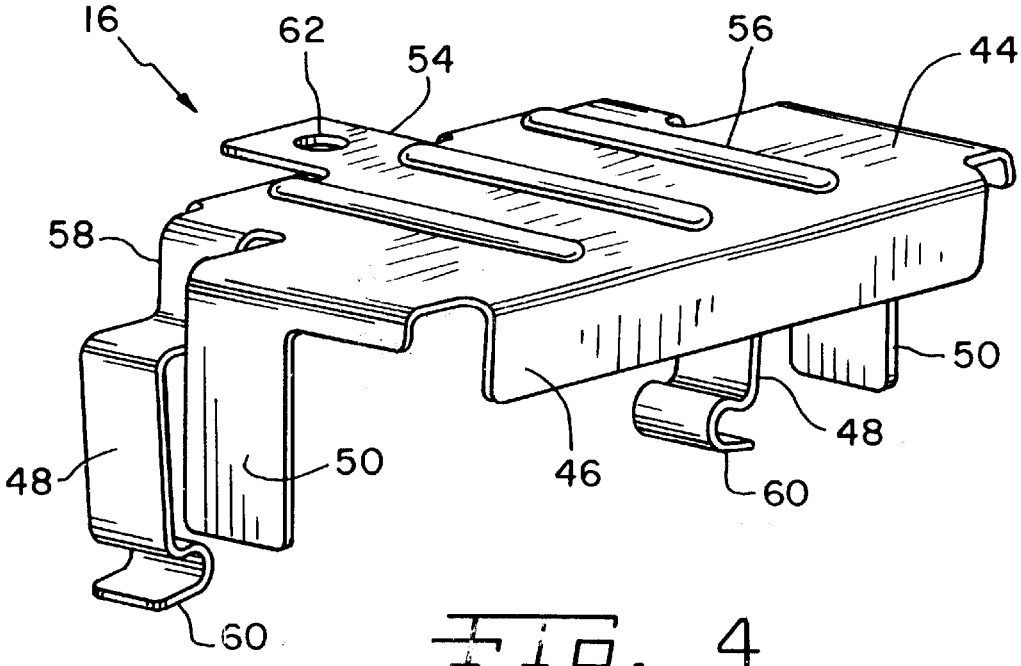
FIG. 4 is another perspective view of the retainer clip shown in FIGS. 1–3.
Figure 5:
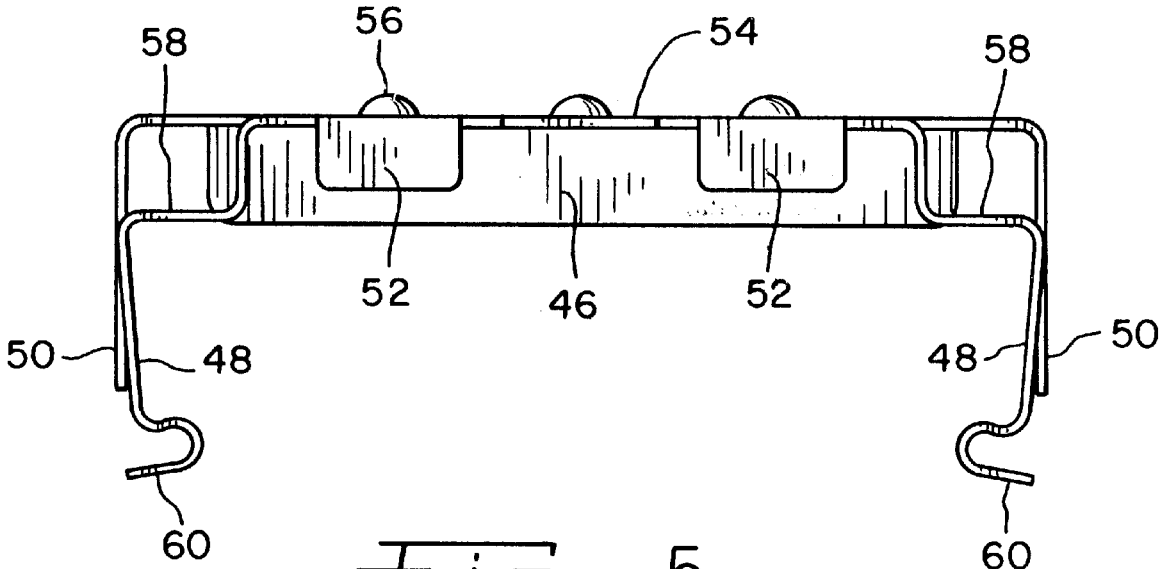
FIG. 5 is a plan view of the retainer clip shown in FIGS. 1–4.

Referring now to the drawings, and more particularly to FIGS. 1 and 2, there is shown an embodiment of an electrical distribution assembly 10 of the present invention. Electrical distribution assembly 10 generally includes a distribution block assembly 12, distribution member 14 and a pair of retainer clips 16.

Distribution block assembly 12 includes a pair of distribution blocks 18 which are mechanically coupled together using a rigid conduit 20. Rigid conduit 20 includes a hollow interior (not shown) allowing electrical conductors such as insulated wires to electrically interconnect distribution blocks 18.

Each distribution block 18 includes two pairs of opposed, flexible mounting tangs 22 which allow the associated distribution block 18 to be suspended from the bottom of a wall panel 24 within a raceway 26. More particularly, a suitable bracket (not shown) is fastened to wall panel 24 within raceway 26 for attachment with flexible tangs 22.

Each distribution block 18 also includes a pair of first electrical connectors 28 at an outboard end thereof. Electrical connectors 28 each include a plurality of electrical terminals which are arranged in a generally linear array, with the arrays of terminals defining each electrical connector 28 being disposed generally parallel to each other at the outboard end of the associated distribution block 18. Each electrical connector 28 includes a keying feature 30 to ensure that proper polarity is maintained.

Each distribution block 18 also includes a pair of recesses 32 on either side thereof which receive an electrical receptacle 34 therein. A receptacle connector (not visible) within recess 32 mates with a corresponding electrical connector of electrical receptacle 34.

Distribution member 14, in the embodiment shown, is in the form of a jumper cable including a pair of second electrical connectors 36 which are mechanically and electrically interconnected together via a flexible conduit 38. Flexible conduit 38 is hollow to allow electrical conductors such as insulated wires to electrically connect second electrical connectors 36 together.

Each second electrical connector 36 of jumper cable 14 includes a plurality of electrical terminals which are arranged in a substantially linear array and mate with the corresponding terminals of a selected first electrical connector 28. Each second electrical connector 36 includes a pair of end walls 40 at opposite ends of the array of electrical terminals. A pair of lugs 42 extend laterally from second electrical connector 36 adjacent each end wall 40.

According to an aspect of the present invention, retainer clips 16 are separate from each of distribution block assembly 12 and jumper cable 14. Retainer clips 16 are used to mechanically couple and prevent the electrical decoupling of first electrical connector 28 and second electrical connector 36.

Each retainer clip 16 includes a central body 44, retention lip 46, resilient arms 48, lateral stability arms 50, stand-offs 52 and tab 54. Central body 44 is generally plate-shaped and may include one or more strengthening ribs 56 formed therein. In the embodiment shown, central body 44 has an overall, generally rectangular shape with dimensions in the major axis direction exceeding the dimension in the minor axis direction.

Retention lip 46 extends generally perpendicular to central body 44 along the longer axis thereof. Retention lip 46 is sized and configured to fit within recess 32 of an attached distribution block 18, as shown in FIG. 1. More particularly, retention lip 46 fits into the portion of a corresponding recess 32 between a side wall of recess 32 and an associated electrical receptacle 34. Retention lip 46 can be configured depending upon the space constraints within recess 32. For example, retention lip 46 may include notches, or may be a split design, etc.

Resilient arms 48 are sized and configured to provide a resilient clamping force against a selected portion of jumper cable 14. In the embodiment shown in FIGS. 1 and 2, resilient arms 48 clamp against end walls 40 and behind an associated lug 42 on a side opposite from an attached distribution block 18. As may be seen in FIG. 2, each resilient arm 48 includes a 90° bent portion 58 which fits behind a lug 42 extending laterally from one side of end wall 40; and a beveled bent portion 60 positioned behind a lug 42 extending laterally on the opposite side of end wall 40. Beveled bent portion 60 applies an outward biasing force against resilient arm 48 to allow resilient arm 48 to be clamped in place on second electrical connector 36.

It will be appreciated that the material and geometric properties of each resilient arm 48 must be selected such that resilient arms 48 may be biased outwardly during clamping of retainer clips 16 with second electrical connectors 36 and then spring back into a clamped position against second electrical connectors 36 without substantial permanent deformation. In the embodiment shown, resilient arms 48 are constructed from 301 full hard stainless steel having a width of 0.225 inch and a thickness of 0.020 inch. Other configurations are of course also possible, depending upon the particular portion of a selected second electrical connector 36 with which retainer clip 16 is attached.

Lateral stability arms 50 lie adjacent opposite end walls 40 of second electrical connector 36. Lateral stability arms 50 inhibit side-to-side movement of retainer clip 16 relative to second electrical connector 36.

Stand-offs 52 extend generally perpendicular to central body 44 and provide multiple functionality. First, stand-offs 52 maintain central body 44 at a predetermined distance from second electrical connector 36. Moreover, stand-offs 52 inhibit pivoting of second electrical connector 36 relative to distribution block 18 by providing a stop limit in the event that second electrical connector 36 is twisted in a lateral direction relative to first electrical connector 28. Additionally, stand-offs 52 provide a stop limit for snapping engagement of resilient arms 48. That is, stand-offs 52 provide a stop limit when resilient arms 48 are snapped into place on opposite end walls 40 of a second electrical connector 36.

Tab 54 is monolithically formed with central body 44, and extends in a direction away from distribution block 18. Tab 54 is positioned between stand-offs 52 and includes a hole 62 therein. Hole 62 detachably couples with retaining strap 64, which in turn retains retainer clip 16 in place on jumper cable 14 when retainer clip 16 is decoupled from first electrical connector 28 and second electrical connector 36.

Figure 6:
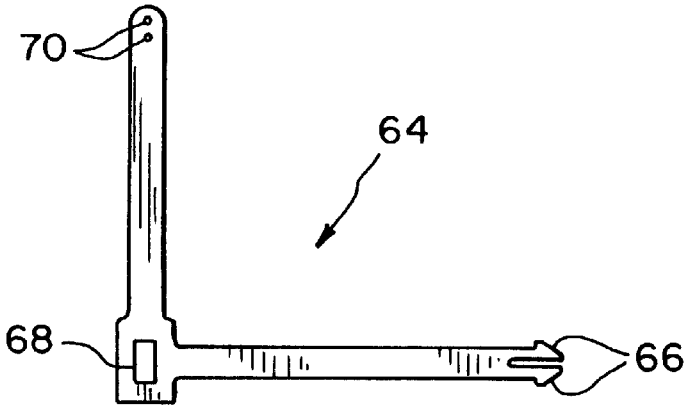
FIG. 6 illustrates an embodiment of a retaining strap used with the retainer clip of FIGS. 1–5.

Retaining strap 64 is formed from a flexible material, such as plastic. Retaining strap 64 has a generally L-shape when in an unfolded position as shown in FIG. 6. Retaining strap 64 includes projections 66 separated by a slot therebetween, which projections 66 fit into a loop 68. When projections 66 and loop 68 are coupled together, retaining strap 64 fits around flexible conduit 38 as shown in FIG. 1. An opposite end of retaining strap 64 includes nubs 70 which fit within hole 62 of tab 54 and allow retaining strap 64 to be detachably coupled with retainer clip 16.

During use, second electrical connector 36 is coupled with a selected first electrical connector 28 by aligning the mating electrical terminals and sliding second electrical connector 36 into place on a first electrical connector 28, thereby electrically coupling first electrical connector 28 and second electrical connector 36 together. Retainer clip 16 is then positioned relative to first electrical connector 28 and second electrical connector 36 such that retention lip 46 aligns with a portion of recess 32 adjacent electrical receptacle 34. Retention lip 46 is then slid into place within recess 32 at a tilted or canted angle. Pressure is then applied to the opposite end of retainer clip 16, thereby causing resilient arms 48 to engage second electrical connector 36. The pressure applied to retainer clip 16 causes second electrical connector 36 to in turn apply an outward, biasing force against beveled bent portion 60, thereby pivoting resilient arms 48 away from second electrical connector 36. Continued pressure against retainer clip 16 causes retainer clip 16 to move to the position shown in FIG. 2, whereby resilient arms 48 snap into place behind lugs 42 extending from each end wall 40. To remove retainer clips 16, the process described above may be reversed.

As an alternative, it is also possible to first engage resilient arms 48 with second electrical connector 36 and bias arms 48 outwardly. Retainer clip 16 may then be pushed so that central body portion 44 remains generally parallel to first electrical connector 28 and second electrical connector 36 until resilient arms 48 snap into place and retention lip 46 is seated within recess 32.

In the embodiment of electrical distribution assembly 10 described above, distribution block assembly 12 is in the form of an electrical receptacle block assembly and distribution member 14 is in the form of a jumper cable. However, it will be appreciated that distribution block assembly and/or distribution member 14 may form other parts of a modular electrical distribution assembly within a modular wall panel. For example, distribution block assembly may be in the form of a power feed block with the first electrical connector and the distribution member may be in the form of electrical receptacle block, a T-distribution block, an L-distribution block, etc.

Figure 7:
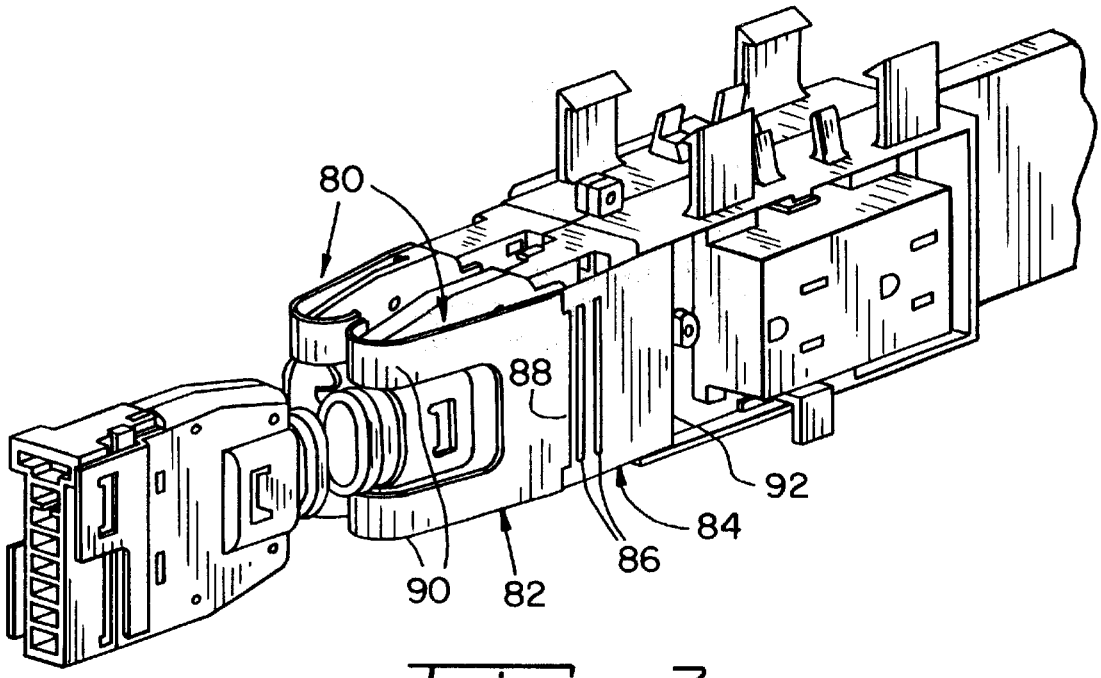
FIG. 7 is a perspective view of another embodiment of a retainer clip of the present invention.
Figure 8:
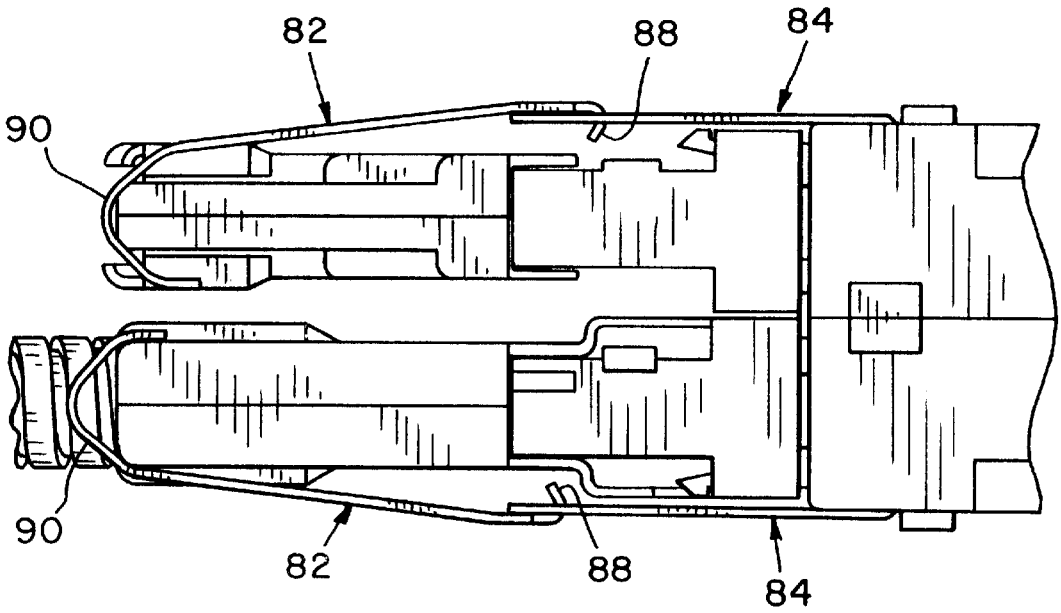
FIG. 8 is a top view of the retainer clip shown in FIG. 7.

FIGS. 7 and 8 illustrate another embodiment of a retainer clip 80 of the present invention. Like retainer clip 16, retainer clip 80 also mechanically couples first electrical connector 28 with second electrical connector 36 and prevents electrical decoupling therebetween. Retainer clip 80 has a two part construct, including a generally U-shaped member 82 and hook plate 84. Hook plate 84 includes a plurality of generally parallel slots 86 formed therein, such as the three slots shown. Slots 86 allow the overall length of retainer clip 80 to be adjusted to accommodate different electrical connector assemblies. Hook plate 84 also includes retention lip 92 which fits within recess 32 of distribution block 18.

U-shaped member 82 includes a projection 88 which fits into a selected slot 86. U-shaped member 82 also includes a pair of hooks 90 which fit behind first electrical connector 28.

During use, first electrical connector 28 and second electrical connector 36 are coupled together. Hooks 90 of U-shaped member 82 are then positioned as shown on first electrical connector 28. Retention lip 92 is inserted into recess 32.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical distribution assembly comprising:

a distribution block including a first electrical connector;

a distribution member including a second electrical connector and a recess, said second electrical connector mating with said first electrical connector; and a retainer clip separate from each of said distribution block and said distribution member, said retainer clip mechanically coupled with and preventing electrical decoupling of said first electrical connector and said second electrical connector, said retainer clip includes at least one stand-off, a central body, a retention lip extending from said body and at least one resilient arm extending from said body, each said stand-off configured for positioning said retainer clip relative to said second electrical connector, said retention lip extending into said recess, each said arm engaged with said distribution member.

2. The electrical distribution assembly of claim 1, wherein said central body is generally plate-shaped.

3. An electrical distribution assembly, comprising:

a distribution block including a first electrical connector and a recess;

a distribution member including a second electrical connector, said second electrical connector mating with said first electrical connector; and a retainer clip separate from each of said distribution block and said distribution member, said retainer clip mechanically coupled with and preventing electrical decoupling of said first electrical connector and said second electrical connector, said retainer clip includes a central body, a retention lip extending from said body and a pair of resilient arms extending from said body, each said resilient arm resiliently biased against said distribution member, said retention lip extending into said recess, each said arm engaged with said distribution member.

4. The electrical distribution assembly of claim 3, wherein said second electrical connector includes a plurality of electrical terminals arranged in an array, and a pair of end walls at opposite ends of said array, each said resilient arm based against an associated said end wall.

5. The electrical distribution assembly of claim 4, wherein said second electrical connector includes at least one lug associated with each said end wall, each said resilient arm disposed adjacent to an associated said lug on a side of said lug opposite from said distribution block.

6. An electrical distribution assembly, comprising:

a distribution block including a first electrical connector and a recess;

a distribution member including a second electrical connector, said second electrical connector mating with said first electrical connector; and a retainer clip separate from each of said distribution block and said distribution member, said retainer clip mechanically coupled with and preventing electrical decoupling of said first electrical connector and said second electrical connector, said retainer clip includes a central body, a retention lip extending from said body, a pair of resilient arms extending from said body, and a pair of lateral stability arms, each said lateral stability arm disposed adjacent a respective said resilient arm, said retention lip extending into said recess, each said arm engaged with said distribution member.

7. The electrical distribution assembly of claim 6, wherein said retainer clip includes at least one stand-off, each said stand-off positioning said retainer clip relative to said second electrical connector.

8. The electrical distribution assembly of claim 7, wherein said distribution member comprises a jumper cable with a flexible conduit attached to said second electrical connector, and said retainer clip includes a tab with a hole therein, and further including a retention strap interconnecting said retainer clip and said conduit.

9. A device for coupling a first electrical connector associated with a distribution block and a second electrical connector associated with a distribution member, comprising:

a retainer clip configured for mechanically coupling with each of and preventing electrical decoupling of said first electrical connector and said second electrical connector, said retainer clip including a central body, a retention lip extending from said body, at least one resilient arm extending from said body and at least one stand-off, each said stand-off configured for positioning said retainer clip relative to said second electrical connector.

10. The coupling device of claim 9, wherein said central body is generally plate-shaped.

11. The coupling device of claim 9, wherein said at least one resilient arm comprises a pair of resilient arms.

12. A device for coupling a first electrical connector associated with a distribution block and a second electrical connector associated with a distribution member, comprising:

a retainer clip configured for mechanically coupling with each of and preventing electrical decoupling of said first electrical connector and said second electrical connector, said retainer clip including a central body, a retention lip extending from said body, a pair of resilient arms extending from said body and a pair of lateral stability arms, each said lateral stability arm disposed adjacent a respective said resilient arm.

13. A method of coupling a first electrical connector and a second electrical connector, comprising the steps of providing a distribution block including a recess and said first electrical connector;

providing a distribution member including said second electrical connector;

providing a retainer clip including a central body, a retention lip extending from said body and at least one resilient arm extending from said body;

coupling said first connector and said second connector together;

inserting said retention lip into said recess; and engaging each said arm with said second electrical connector and said distribution member, whereby electrical decoupling of said first electrical connector and said second electrical connector is prevented.

* * * * *